US009316082B2

(12) United States Patent
Nielsen

(10) Patent No.: US 9,316,082 B2
(45) Date of Patent: Apr. 19, 2016

(54) WELL CAP ASSEMBLY

(71) Applicant: Christopher Nielsen, Chelsea (CA)

(72) Inventor: Christopher Nielsen, Chelsea (CA)

( * ) Notice: Subject to any disclaimer, the term of this patent is extended or adjusted under 35 U.S.C. 154(b) by 323 days.

(21) Appl. No.: 13/815,156

(22) Filed: Feb. 5, 2013

(65) Prior Publication Data

US 2014/0216716 A1 Aug. 7, 2014

(51) Int. Cl.
*E21B 33/02* (2006.01)
*E21B 33/04* (2006.01)

(52) U.S. Cl.
CPC ..... *E21B 33/04* (2013.01); *E21B 33/02* (2013.01)

(58) Field of Classification Search
CPC ..... E21B 33/02; E21B 33/03
See application file for complete search history.

(56) References Cited

U.S. PATENT DOCUMENTS

| | | | | |
|---|---|---|---|---|
| 2,090,213 | A * | 8/1937 | Madely | 277/329 |
| 3,568,769 | A * | 3/1971 | Maass | 166/75.13 |
| 5,111,879 | A * | 5/1992 | Jozwiak et al. | 166/93.1 |
| 5,437,309 | A * | 8/1995 | Timmons | 138/89 |
| 5,664,626 | A * | 9/1997 | Watts, III | 166/75.13 |
| 2013/0048312 | A1 * | 2/2013 | Walls | 166/386 |

* cited by examiner

*Primary Examiner* — David Bagnell
*Assistant Examiner* — Michael Goodwin
(74) *Attorney, Agent, or Firm* — George A. Seaby

(57) ABSTRACT

A cap assembly for sealing the open end of a well casing or other pipe includes a top plate for mounting on the open end of the pipe, a bottom plate spaced apart from the top plate, an upper expansible gasket sandwiched between the top plate and an upper clamping plate, a lower expansible gasket sandwiched between the bottom plate and a lower clamping plate, spacer sleeves extending between the clamping plates, bolts through the bottom plate, both gaskets and clamping plates, the sleeves and the top plate, and nuts on the bolts. When the bolts are tightened on the nuts, the gaskets expand to seal the pipe at spaced apart locations.

3 Claims, 3 Drawing Sheets

WELL CAP ASSEMBLY

BACKGROUND OF THE INVENTION

1. Field of the Invention

This invention relates to an assembly for sealing the open end of a pipe. More specifically, the invention relates to a well cap assembly for sealing the top end of a well casing, which is used to extract a fluid from the ground.

While the assembly of the present invention was designed to seal the top end of a well casing at a landfill site, it will be appreciated that the assembly can be used on other pipes or conduits such as the casings of oil or gas wells.

It has been found that when well casings are being installed at a well site it is not uncommon for the top end of the casing to be out somewhat less than perpendicular the longitudinal axis of the casing, i.e. the casing is not cut 'square'. Moreover, a casing is often not perfectly round. Accordingly, caps and gasket on the top end of the pipe do not always provide a good seal, permitting the unintentional escape of well fluids (gases and/or liquids) from the well or, when the well is under vacuum, allowing the ingress of fluids into the well.

2. Description of the Related Art

A literature search discloses a variety of pipe seals including those described in U.S. Pat. No. 3,494,504, issued to J. C. Jackson on Feb. 10, 1970; U.S. Pat. No. 3,667,640, issued to Joseph. G. Morrow on Jun. 6, 1972; U.S. Pat. No. 3,901,167, issued to Dale C. Reese on Aug. 26, 1975; U.S. Pat. No. 4,175,671 issued to Harold H. Holl et al on Nov. 27, 1979; U.S. Pat. No. 4,303,101, issued to James W. Tholen on Dec. 1, 1981; U.S. Pat. No. 4,415,005, issued to Harlo W. Jahzen on Nov. 15, 1983; U.S. Pat. No. 4,493,344, issued to Allen D. Mathison et al on Jan. 15, 1985; U.S. Pat. No. 4,848,458, issued to Thomas S. Holdsworth et al on Jul. 18, 1989; U.S. Pat. No. 5,437,309, issued to Robert D. Timmons on Aug. 1, 1995; and U.S. Pat. No. 7,464,727, issued to Richard E. Larson et al on Dec. 16, 2008. Many of the patented devices include molded elements which would result in high production costs. Others of the devices would not provide a solution to the problem described above.

BRIEF SUMMARY OF THE INVENTION

The cap assembly of the present invention provides a solution to the above-identified problems. Moreover, the cap assembly of the present invention is structurally simple and easy and inexpensive to manufacture.

In its simplest form, the cap assembly of the present invention includes:

a thick top plate for mounting on the top end of a well casing or on the open end of another pipe, a bottom plate spaced apart from the top plate, a first expansible gasket immediately beneath the top plate, an upper clamping plate beneath and abutting the bottom of the first gasket, a second expansible, gasket on the bottom plate, a lower clamping plate on the second gasket spaced apart from the upper clamping plate, a plurality of sleeves extend between the upper and lower clamping plates for maintaining a fixed spacing between the clamping plates, bolts extending through the top plate, the first gasket, the upper clamping plate, the sleeves, the lower clamping plate, the second gasket and the bottom plate, and nuts on the bolts, whereby, when the nuts are tightened on the bolts, the top plate moves towards the upper clamping plate to compress the first gasket causing it to expand radially outwardly to create a seal at the top end of the casing, and the bottom plate moves toward the lower clamping plate to compress the second gasket, causing it to expand radially outwardly to create a seal at a location beneath and spaced part from such lop end of the casing.

The well cap assembly seals the top end of a casing at two separate spaced apart locations, one immediately beneath the top end and the other a short distance beneath such top end of the casing. Thus, during field installation of a pipe, even when the pipe is not cut square or is out of round, good sealing of the casing is achieved.

BRIEF DESCRIPTION OF THE DRAWINGS

The invention is described below in greater detail with reference to the accompanying drawings, which illustrate a preferred embodiment of the invention, and wherein.

DETAILED DESCRIPTION OF THE INVENTION

Figure 1:
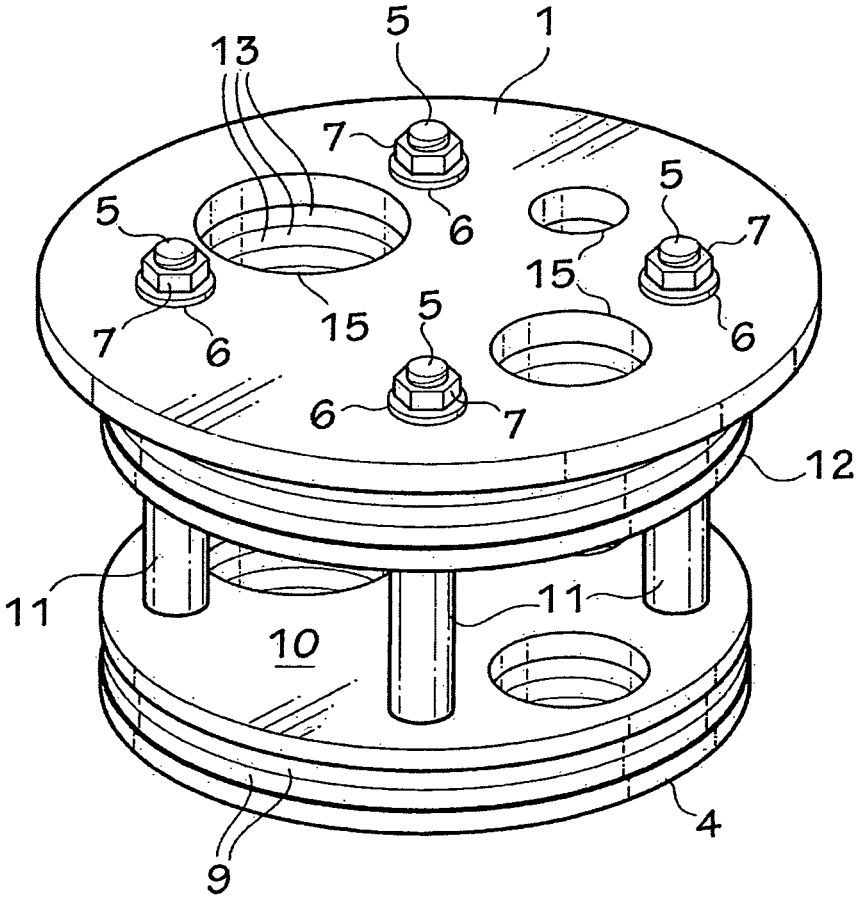
FIG. 1 is an isometric view of a well cap assembly in accordance with the present invention.
Figure 2:
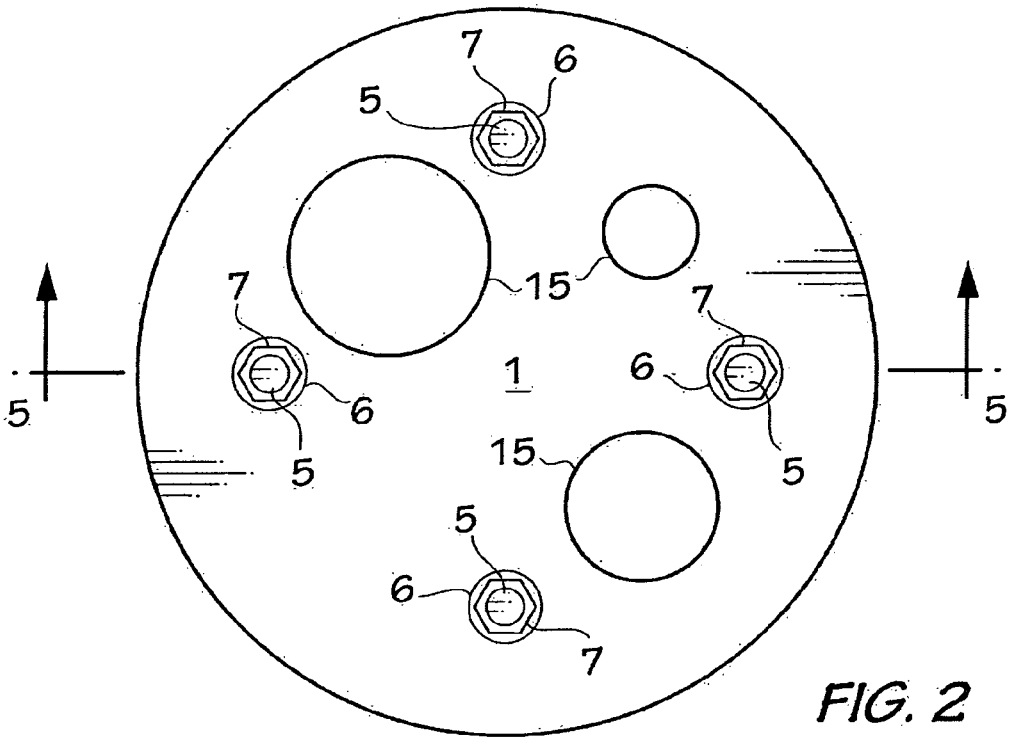
FIG. 2 is top view of the well cap assembly of FIG. 1.
Figure 3:
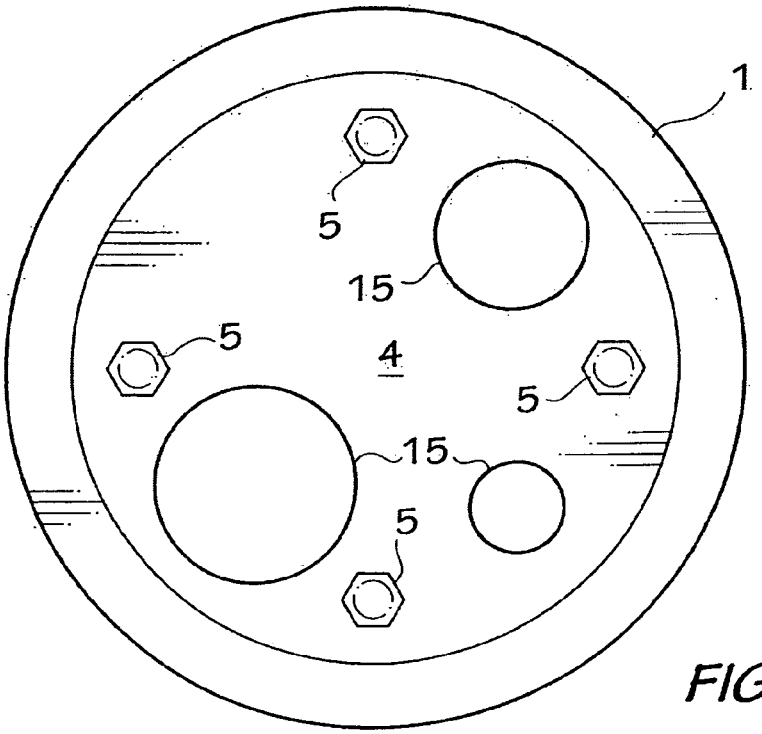
FIG. 3 is a bottom view of the well cap assembly of FIGS. 1 and 2.
Figure 4:
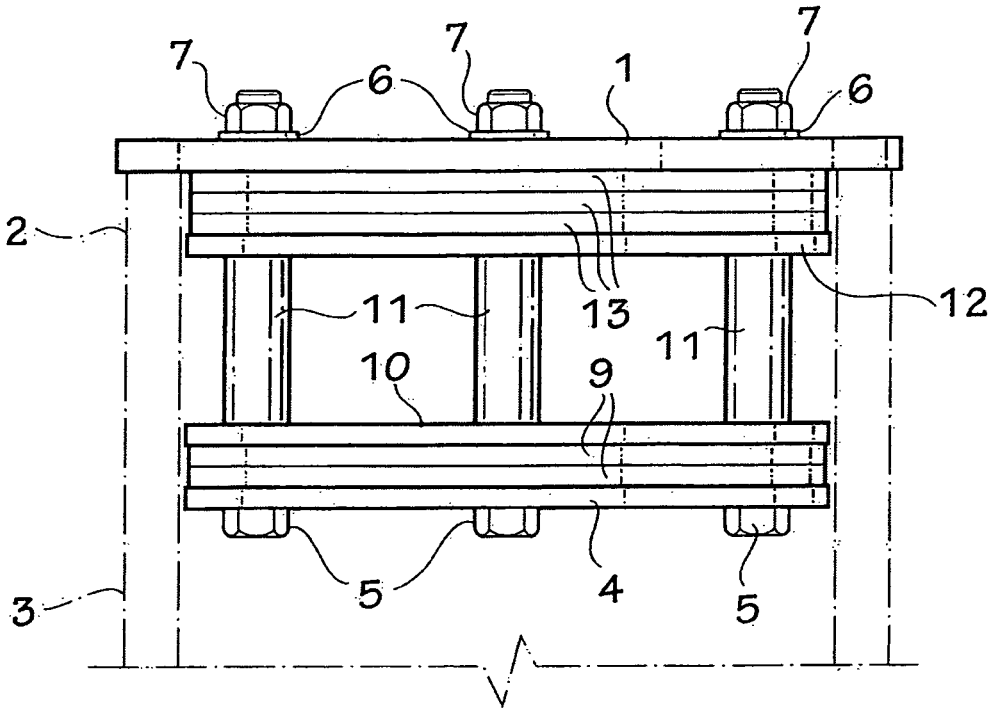
FIG. 4 is a side view of the well cap assembly of FIGS. 1 to 3 mounted on a well casing.
Figure 5:
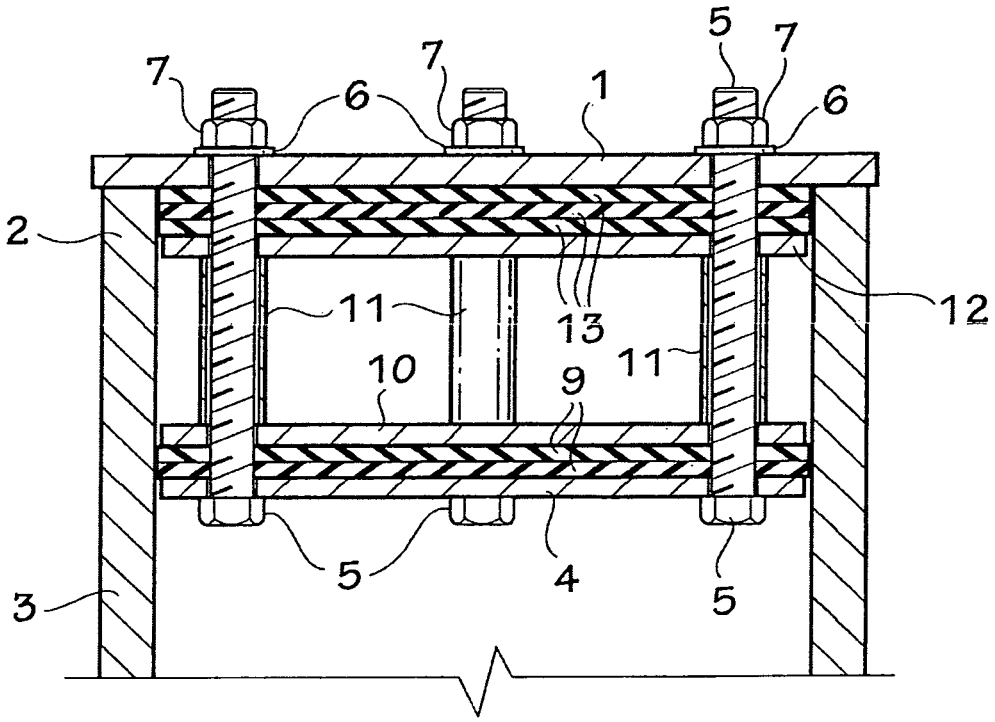
FIG. 5 is a cross section of the well cap assembly taken generally along line 5-5 of FIG. 1.

Referring to FIGS. 1 to 4, the well cap assembly of the present invention includes a thick top plate 1 for mounting on the top end 2 of a well casing 3 (FIGS. 4 and 5). The top plate 1 is formed of powder coated or stainless steel, and has a diameter larger than the outside diameter of the casing 3 on which it is mounted. A thinner, steel bottom plate 4 is connected to the top plate 1 by bolts 5, washers 6 and nuts 7.

The bolts 5 extend upwardly through the bottom plate 4, a pair of expansible lower gaskets 9, a lower clamping plate 10, steel spacer sleeves 11, an upper clamping plate 12, three expansible upper gaskets 13 and the top plate 1. The gaskets 9 and 13 are formed of a synthetic rubber such as nitrile or EPDM (ethylene propylene diene monomer) rubber. The reason for using a plurality of thin gaskets 9 and 13 is that the durometer rating (hardness) of such gaskets is consistent over the entire area of the gaskets which is not always the case with a thick gasket. Thus, while a single thick gasket could be used, it is preferable to use a plurality of thin, expansible gaskets sandwiched together.

Access openings 15 are provided in the top and bottom plates 1 and 4, respectively and in the gaskets 9 and 13. The openings are intended to receive pipes (not shown) for removing fluid from the well, sampling, pressure monitoring and other purposes. If the cap assembly is used solely to seal the top end of a well casing or the open end of another pipe, there are no openings 15 in the various layers of the assembly.

For sealing a 4" pipe, the preferred dimensions of the various elements of the cap assembly are as follows: the top plate 1 has a diameter of 5 inches and a thickness of 0.375 inch; each of the bottom plate 4, the gaskets 9 and 13, and the clamping plates 10 and 12 has a diameter of 3.73 inches and a thickness of 25 inch; and each spacer sleeve 11 has a length of 2 inches. For sealing a six inch pipe, the preferred dimensions of the elements of the cap assembly are as follows: the top plate has a diameter of 7.125 inches and a thickness of 0.375 inch; each of the bottom plate 4 and the clamping plates 10 and 12 has a diameter of 5.636 inches and a thickness of 0.25 inch; each of the gaskets 9 and 13 has a diameter of 5.64 inches and a thickness of 0.25 inch; and each spacer sleeve 11 has a length of 2 inches.

For sealing an eight inch pipe, the preferred dimensions of the elements of the cap assembly are as follows: the top plate has a diameter of 9.125 inches and a thickness of 0.375 inch; each of the bottom plate 4, the gaskets 9 and 13 and the clamping plates 10 and 12 has a diameter of 7.49 inches and a thickness of 0.25 inch; and each spacer sleeve 11 has a length of 2 inches.

In use, the assembly is placed on the top end 2 of the well casing 3 or in the open end of any other pipe (not shown) to be sealed. The nuts 7 are tightened on the bolts 5, causing the top plate 1 to move towards the clamping plate 12, and the bottom plate 4, to move towards the clamping plate 10. Because of the solid sleeves 11 extending therebetween, the clamping plates 10 and 12 cannot move relative to each other. The result is that the expansible gaskets 9 and 13 are compressed, causing them to expand radially against the interior wall of the casing 3 and to seal against the bolts 5. When the top plate 1, the bottom plate 4, the clamping plates 10 and 12 and the gaskets 9 and 13 contain openings 15 with pipes therein, the gaskets 9 and 13 also seal against the pipes.

The invention claimed is:

1. A cap assembly for sealing an open top end of a well casing or an open end of another pipe comprising:

a thick top plate for mounting on the top end of the well casing or on the open end of another pipe, a bottom plate spaced apart from the top plate, an upper expansible gasket immediately beneath the top plate, an upper clamping plate beneath and abutting the bottom of the upper expansible gasket, a lower expansible gasket on the bottom plate, a lower clamping plate on the lower expansible gasket spaced apart from the upper clamping plate, a plurality of sleeves extending between the upper and lower clamping plates for maintaining a fixed spacing between the clamping plates, bolts extending through the top plate, the upper expansible gasket, the upper clamping plate, the sleeves, the lower clamping plate, the lower expansible gasket and the bottom plate, and nuts on the bolts, whereby, when the nuts are tightened on the bolts, the top plate moves towards the upper clamping plate to compress the upper expansible gasket causing it to expand radially outwardly to create a seal at the open top end of the casing or at said open end of another pipe and the bottom plate moves toward the lower clamping plate to compress the lower expansible gasket, causing it to expand radially outwardly to create a seal at a location beneath and spaced apart from such open top end of the well casing or said open end of another pipe.

2. The cap assembly of claim 1, wherein said upper expansible gasket includes a plurality of first gaskets sandwiched together between said top plate and said upper clamping plate, said first gaskets being sufficiently thin that their hardness is consistent over their entire area.

3. The cap assembly of claim 2, wherein said lower expansible gasket includes a plurality of second gaskets sandwiched together between said bottom plate and said lower clamping plate, said second gaskets being sufficiently thin that their hardness is consistent over their entire area.

* * * * *